US011333140B2

(12) United States Patent
Hahn et al.

(10) Patent No.: US 11,333,140 B2
(45) Date of Patent: May 17, 2022

(54) COOLING BLOCK FOR MULTI-CYLINDER AIR COMPRESSOR

(71) Applicant: Caterpillar Inc., Deerfield, IL (US)

(72) Inventors: Daniel Scott Hahn, Washington, IL (US); Brian Douglas Hoff, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 61 days.

(21) Appl. No.: 16/438,043

(22) Filed: Jun. 11, 2019

(65) Prior Publication Data

US 2020/0392951 A1 Dec. 17, 2020

(51) Int. Cl.
*F04B 39/06* (2006.01)
*F04B 35/00* (2006.01)
*F04B 27/00* (2006.01)

(52) U.S. Cl.
CPC ..... *F04B 39/06* (2013.01); *F04B 27/00* (2013.01); *F04B 35/002* (2013.01)

(58) Field of Classification Search
CPC ..... F04B 27/00; F04B 35/002; F04B 39/06
See application file for complete search history.

(56) References Cited

U.S. PATENT DOCUMENTS 2,844,301 A * 7/1958 Newton ..... F25B 31/00 417/339
4,777,917 A * 10/1988 Williams ..... F01L 7/029 123/190.5
8,317,488 B2 11/2012 Hartl
9,279,420 B2 3/2016 Moore et al.
10,704,450 B2 * 7/2020 Mark ..... F01M 1/08
2003/0005893 A1 * 1/2003 Bontaz ..... F01P 3/08 123/41.35
2004/0040520 A1 * 3/2004 Bontaz ..... F01P 3/08 123/41.35
2007/0041847 A1 2/2007 Inoue et al.
2008/0210314 A1 * 9/2008 Neto ..... F16K 15/044 137/539
2008/0223318 A1 * 9/2008 Perotto ..... F01P 3/08 123/41.35
2010/0001103 A1 * 1/2010 Neto ..... F01P 3/08 239/583
2010/0221128 A1 9/2010 Mellar et al.
2015/0075369 A1 3/2015 Kapadia et al.
2015/0322937 A1 * 11/2015 Hritz ..... F04B 39/0094 417/53

(Continued)

FOREIGN PATENT DOCUMENTS

CH 617986 A5 6/1980
CN 202187818 4/2012

(Continued)

*Primary Examiner* — Patrick Hamo
(74) *Attorney, Agent, or Firm* — Bookoff McAndrews PLLC

(57) ABSTRACT

A cooling block for cooling pistons of a multi-cylinder air compressor is disclosed. The cooling block may comprise a body including a first end and a second end on opposing sides of the body. The cooling block may further comprise a first cooling nozzle near the first end, and a second cooling nozzle near the second end. The first cooling nozzle and the second cooling nozzle may each include an orifice through which coolant is sprayed into a crankcase of the multi-cylinder air compressor.

20 Claims, 9 Drawing Sheets

(56) References Cited

U.S. PATENT DOCUMENTS

| | | | | |
|---|---|---|---|---|
| 2018/0363537 | A1* | 12/2018 | Mark | B05B 1/06 |
| 2020/0325988 | A1* | 10/2020 | Barnes | B22F 7/08 |

FOREIGN PATENT DOCUMENTS

| | | | |
|---|---|---|---|
| EP | 0279968 | A1 | 8/1988 |
| EP | 3415736 | | 12/2018 |
| JP | 2006274933 | A | 10/2006 |

* cited by examiner

COOLING BLOCK FOR MULTI-CYLINDER AIR COMPRESSOR

TECHNICAL FIELD

The present disclosure generally relates to piston cooling systems for air compressors and, more specifically, to cooling blocks for cooling the pistons of multi-cylinder air compressors used in armored hull vehicles.

BACKGROUND

Multi-cylinder air compressors include two or more cylinders with a piston in each cylinder that reciprocate to generate compressed air. For example, a dual cylinder air compressor includes a crankcase which houses a crankshaft, two cylinders, and two connecting rods each mounted on the crankshaft on one end and connected to one of the pistons on the other end. The connecting rods move the pistons up and down within the cylinders as the crankshaft rotates. In operation, air is drawn into the cylinders as the pistons move down and create a partial vacuum in the cylinders. The air is subsequently compressed and pushed out of the cylinders as the pistons move up and increase the pressure in the cylinders. The compressed air thus generated may be collected in a tank and stored for various uses.

Multi-cylinder air compressors may be used in compressed air supply systems for applications that require higher amounts of compressed air. For example, dual cylinder air compressors may be used to meet the high compressed air demands for operating the air brakes and the central tire air inflation systems of eight wheel drive armored hull combat vehicles. In this example, the dual cylinder air compressor may be connected to and driven by the engine of the combat vehicle. However, the air compressor pistons used in such applications may overheat and seize due to the high demands on the compressor, as well as the hot environment in the space around the compressor created by the engine operating inside of the hull. Accordingly, without an effective piston cooling system, the pistons in such applications may have a low duty cycle, or period of use before the pistons overheat.

U.S. Pat. No. 8,317,488 describes a dry-running (or oil-free) multi-cylinder air compressor having a means for generating a cooling air flow though the interior of the crankcase. The air compressor described therein includes two cylinders and two pistons each associated with one of the cylinders and operating in separate chambers of the compressor. Cooling air flow is generated by the movement cycle of the pistons and passes through the interior of the crankcase to maintain the compressor at subcritical temperatures. Specifically, as the pistons reciprocate, the cooling air is drawn into the crankcase via separate inlet valves at the top of the compressor near the air intake pipes.

While effective, there remains a need for improved piston cooling system designs for multi-cylinder air compressors used in applications having high compressed air demands, such as combat vehicle applications.

SUMMARY

In accordance with one aspect of the present disclosure, a cooling block for cooling pistons of a multi-cylinder air compressor is disclosed. The cooling block may comprise a body including a first end and a second end on opposite sides of the body. The cooling block may further comprise a coolant inlet, and a first cooling nozzle near the first end having a first orifice through which the coolant is sprayed into a crankcase of the multi-cylinder air compressor. The cooling block may further comprise a second cooling nozzle near the second end having a second orifice through which the coolant is sprayed into the crankcase. In addition, the cooling block may further comprise an internal conduit extending through the body and configured to carry the coolant from the coolant inlet to each of the first and second cooling nozzles.

In accordance with another aspect of the present disclosure, an engine and air compressor system for an armored hull vehicle is disclosed. The engine and air compressor system may comprise an engine that is an in-line six cylinder diesel engine. The engine and air compressor system may further comprise a dual cylinder air compressor connected to and driven by the engine and configured to supply compressed air for operating a central tire air inflation system of the armored hull vehicle. The dual cylinder air compressor may include a crankcase having a bottom, a crankshaft rotatably mounted in the crankcase, two connecting rods mounted on the crankshaft, two cylinders mounted in the crankcase, and a piston arranged within a respective one of the two cylinders at an end of a respective one of the two connecting rods. The engine and air compressor system may further comprise first and second cooling blocks each connected to the bottom of the crankcase and configured to spray coolant into the crankcase for cooling the pistons. Each of the first and second cooling blocks may include a coolant inlet, a first cooling nozzle having a first orifice through which the coolant is spraying into the crankcase, and a second cooling nozzle having a second orifice through which the coolant is sprayed into the crankcase.

In accordance with another aspect of the present disclosure, a dual cylinder air compressor for an armored hull vehicle is disclosed. The dual cylinder air compressor may comprise a crankcase, a crankshaft rotatably mounted in the crankcase, two connecting rods mounted on the crankshaft, two cylinders mounted in the crankcase, and two pistons each arranged in a respective one of the two cylinders at an end of a respective one of the two connecting rods. The dual cylinder air compressor may further comprise a first cooling block connected to a bottom of the crankcase and configured to spray coolant to one of the two pistons, and a second cooling block connected to the bottom of the crankcase and configured to spray coolant to the other of the two pistons. The first and second cooling blocks may each include a first cooling nozzle having a first orifice through which the coolant is sprayed, and a second cooling nozzle having a second orifice through which the coolant is sprayed.

These and other aspects and features of the present disclosure will be more readily understood when read in conjunction with the accompanying drawings.

DETAILED DESCRIPTION

Figure 1:
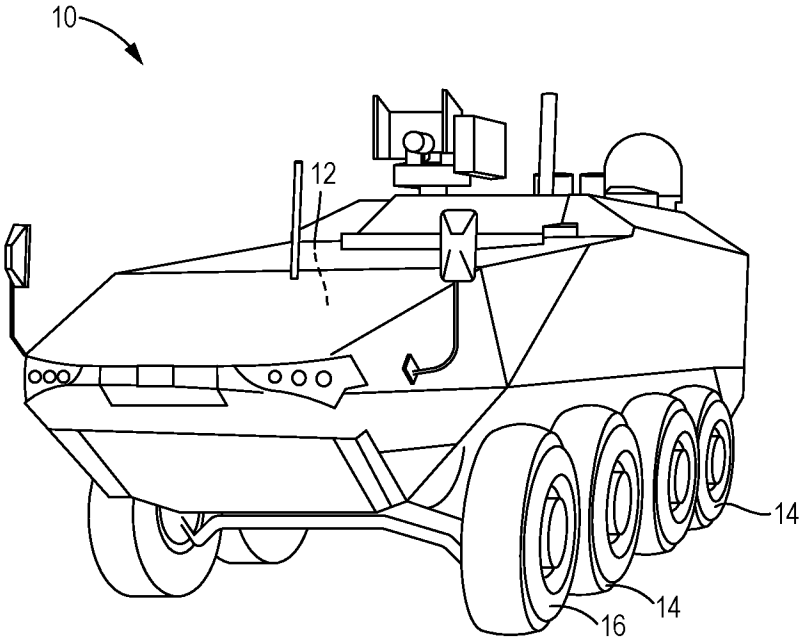
FIG. 1 is a perspective view of an armored hull vehicle, constructed in accordance with the present disclosure.

Referring now to the drawings, and with specific reference to FIG. 1, an armored hull vehicle 10 is shown. In one example, the armored hull vehicle 10 may be an armored hull combat vehicle. The vehicle 10 may include an engine 12 (also see FIG. 3) which may be a high horsepower in-line six cylinder diesel engine, wherein the engine cylinders are mounted in a straight line with all of the pistons driving a common crankshaft. The engine 12 may have a brake horsepower (bhp) that ranges from 350 bhp to 800 bhp. The vehicle 10 may further include wheels 14, such as eight wheels 14, driven by the engine 12. In one example, the vehicle 10 may be an eight wheel drive vehicle in which all eight of the wheels 14 are driven by the engine 12. Inflation and deflation of the tires 16 of the wheels 14 may be controlled by a central tire air inflation system 18 (see FIG. 2 and further details below). As explained in further detail below, a multi-cylinder air compressor 20 may be connected to the engine 12 (see FIG. 3), and may be used to supply compressed air to operate the central tire air inflation system 18 as well as the air brakes of the vehicle 10.

Figure 2:
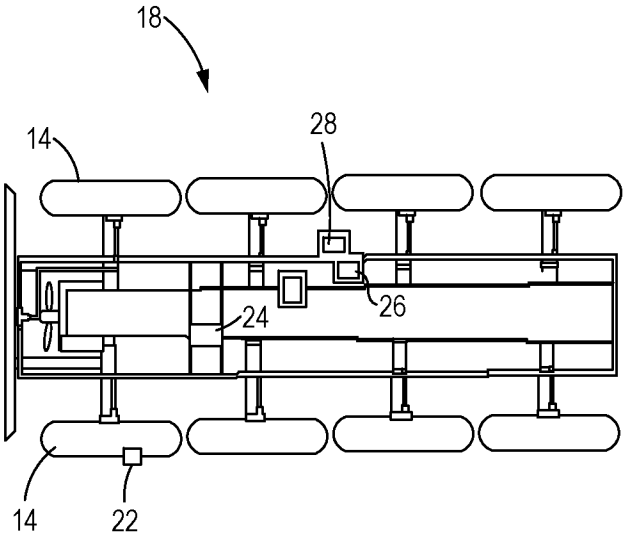
FIG. 2 is a schematic representation of a central tire air inflation system of the armored hull vehicle, in accordance with the present disclosure.

The central tire air inflation system 18 is schematically depicted in FIG. 2. As is understood by those skilled in the art, the central tire air inflation system 18 may include a wheel valve 22 associated with each of the wheels 14, an operator control panel 24, an electronic control unit (ECU) 26, and a pneumatic control unit (PCU) 28 that controls the wheel valves 22 and monitors the pressure of the tires 16. In operation, the driver may input desired tire pressure modes to match the operating conditions. The ECU 26 may monitor the tire pressures (via signals from the PCU 28), and transmit commands to the PCU 28 to inflate and deflate the tires 16 as needed to match the driver's commands. The central tire air inflation system 18 may function to improve the performance of the tires 16 in different operating conditions. For instance, the central tire air inflation system 18 may partially deflate the tires 16 in certain off-road situations, and may inflate the tires 16 at high vehicle speeds.

Figure 3:
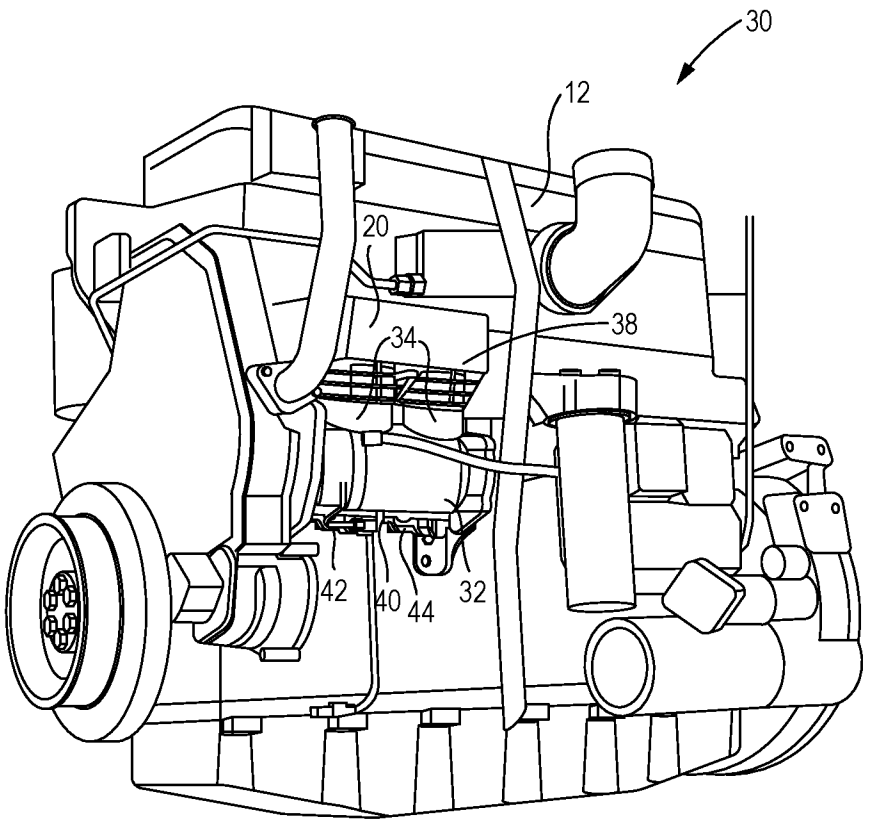
FIG. 3 is a perspective view of an engine and compressor system of the armored hull vehicle including an engine connected to a dual cylinder air compressor, constructed in accordance with the present disclosure.

Turning now to FIG. 3, an engine and compressor system 30 of the vehicle 10 is shown. The engine and compressor system 30 may include the engine 12 and the multi-cylinder air compressor 20. The multi-cylinder air compressor 20 may be bolted onto the engine 12, and may be gear driven by the engine 12. The multi-cylinder air compressor 20 may include a crankcase 32, and two or more cylinders 34 each having a piston 36 that reciprocates therein to generate compressed air (also see FIG. 4). In one arrangement, the multi-cylinder air compressor 20 may be a dual cylinder air compressor 38 having two cylinders 34. The compressed air generated by the multi-cylinder air compressor 20 may be sent to a compressed air tank that supplies compressed air to operate the air brakes and the central tire air inflation system 18 as needed during vehicle operation.

Mounted to a bottom 40 of the crankcase 32 may be two or more cooling blocks for cooling the pistons 36. For example, the dual cylinder air compressor 38 may have a first cooling block 42 and a second cooling block 44 configured to deliver coolant inside of the crankcase 32 for cooling the pistons 36. The first cooling block 42 may deliver coolant to one of the cylinders 34, and the second cooling block 44 may deliver coolant to the other of the two cylinders 34. The coolant may be oil supplied by the engine 12 or from another source. Applicant has found that the use of the two cooling blocks 42 and 44 permits the pistons 36 of the dual cylinder air compressor 38 to operate continuously (continuous duty cycle) without overheating or seizing. More cooling blocks may be used in air compressor designs having more than two cylinders, with each of the cooling blocks delivering coolant to each cylinder.

Figure 4:
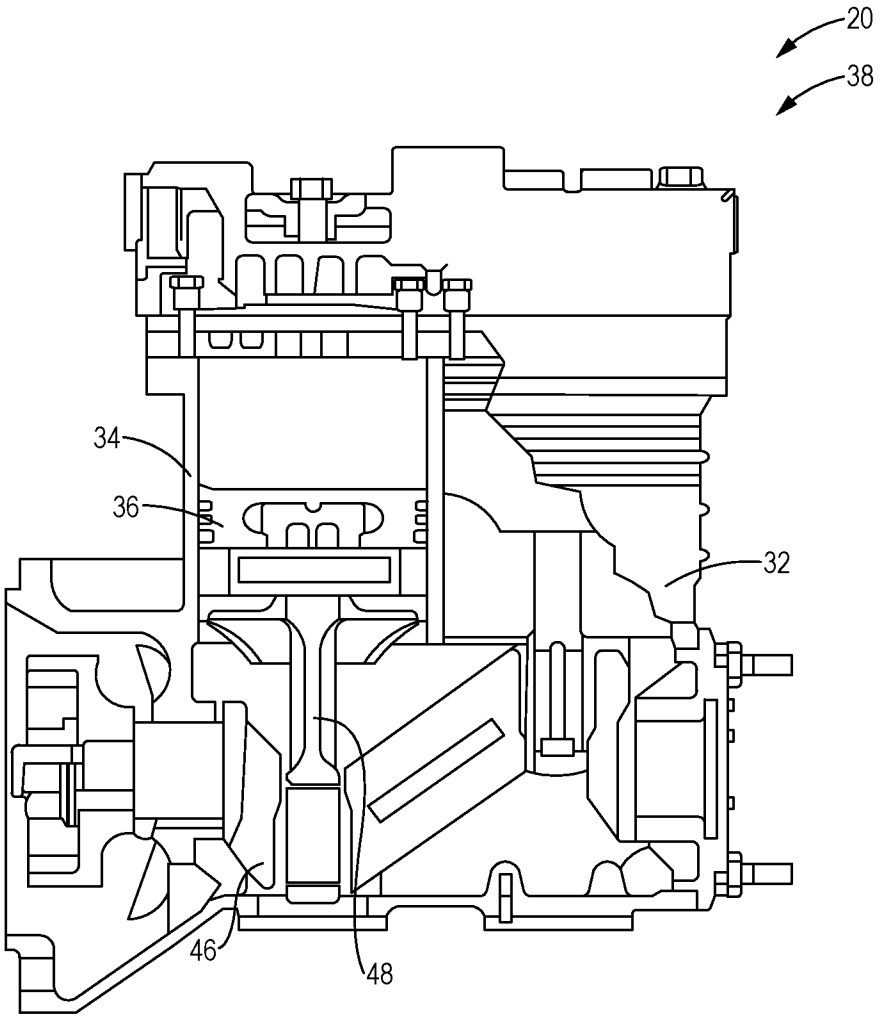
FIG. 4 is a partial cross-sectional view of the dual cylinder air compressor shown in isolation, constructed in accordance with the present disclosure.

The dual cylinder air compressor 38 is shown in greater detail in FIG. 4. The crankcase 32 may include a crankshaft 46 rotatably mounted therein and driven for rotation by the engine 12. In addition, two connecting rods 48 may each be mounted on the crankshaft 46 on one end and coupled to one of the two pistons 36 on the other end. As such, rotation of the crankshaft 46 may drive the reciprocating motion of the pistons 36 in the cylinders 34. As the pistons 36 move downward in their respective cylinders 34, a partial vacuum may be created that draws air into the cylinders 34. As the pistons 36 move upward, pressure is increased to create compressed air and expel the compressed air out of the cylinders 34 for collection in the compressed air tank.

Figure 5:
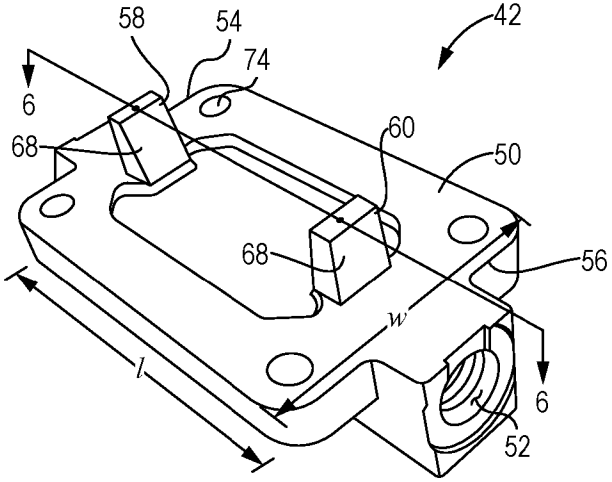
FIG. 5 is a perspective view of one of the cooling blocks for the dual cylinder air compressor, constructed in accordance with the present disclosure.
Figure 6:
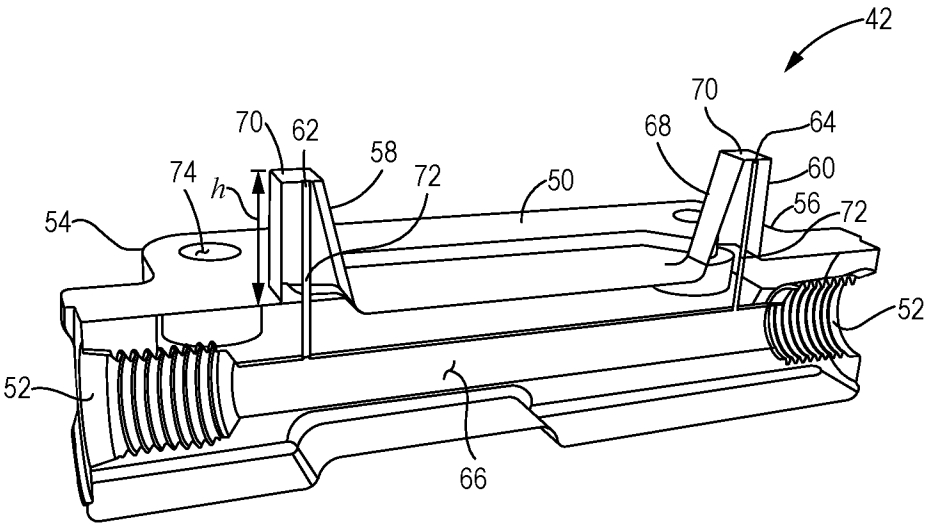
FIG. 6 is a cross-sectional view through the section 6-6 of FIG. 5, constructed in accordance with the present disclosure.

The first cooling block 42 is shown in isolation in FIGS. 5-6. The second cooling block 44 is identical to the first cooling block 42 and, therefore, is not shown. The cooling block 42 may have a body 50 formed from cast iron, or other suitable materials. The body 50 may include a coolant inlet 52 through which the coolant is received from the engine 12. In one arrangement, the cooling block 42 may have two of the inlets 52 (see FIG. 6), with the inlet 52 that is not receiving coolant during operation being plugged. In addition, the body 50 may have a first end 54 and a second end 56 on opposing sides of the body 50. Near the first end 54 may be a first cooling nozzle 58, and near the second end 56 may be a second cooling nozzle 60. The first cooling nozzle 58 may include a first orifice 62 through which the coolant is sprayed into the crankcase 32, and the second cooling nozzle 60 may include a second cooling orifice 64 through which the coolant is sprayed into the crankcase 32 (see FIG. 6). An internal conduit 66 may carry the coolant from the coolant inlet 52 to each of the first and second cooling nozzles 58 and 60 (see FIG. 6). Applicant has found that the use of two cooling nozzles on each of the cooling blocks 42 and 44, as opposed to one cooling nozzle, provides a continuous piston duty cycle in which the pistons run continuously without overheating. Alternative arrangements may include more than two cooling nozzles on each of the cooling blocks.

Each of the first and second cooling nozzles 58 and 60 may include a raised portion 68 extending from the body 50, with the first and second orifices 62 and 64 being located at a top 70 of the respective raised portion 68. The raised portions 68 serve to elevate the first and second orifices 62 and 64 above a pool of oil that may collect at a bottom of the crankcase 32 (see, for example, FIG. 9), so that the coolant is sprayed above the pool of oil. In one arrangement, the raised portions 68 have a height (h) of about 7 millimeters, although the heights of the raised portions 68 may deviate from this depending on the design of the air compressor 38. The first and second nozzles 58 and 60 may be spaced such that the nozzles 58 and 60 are positioned on either side of the crankshaft 46 at certain times during the rotation of the crankshaft 46 (also see FIGS. 8-9 and further details below). This allows the nozzles 58 and 60 to spray the coolant past the crankshaft 46 for impingement on the pistons 36. In one exemplary arrangement, the first and second nozzles 58 and 60 are spaced apart from each other by about 56 millimeters.

Figure 9:
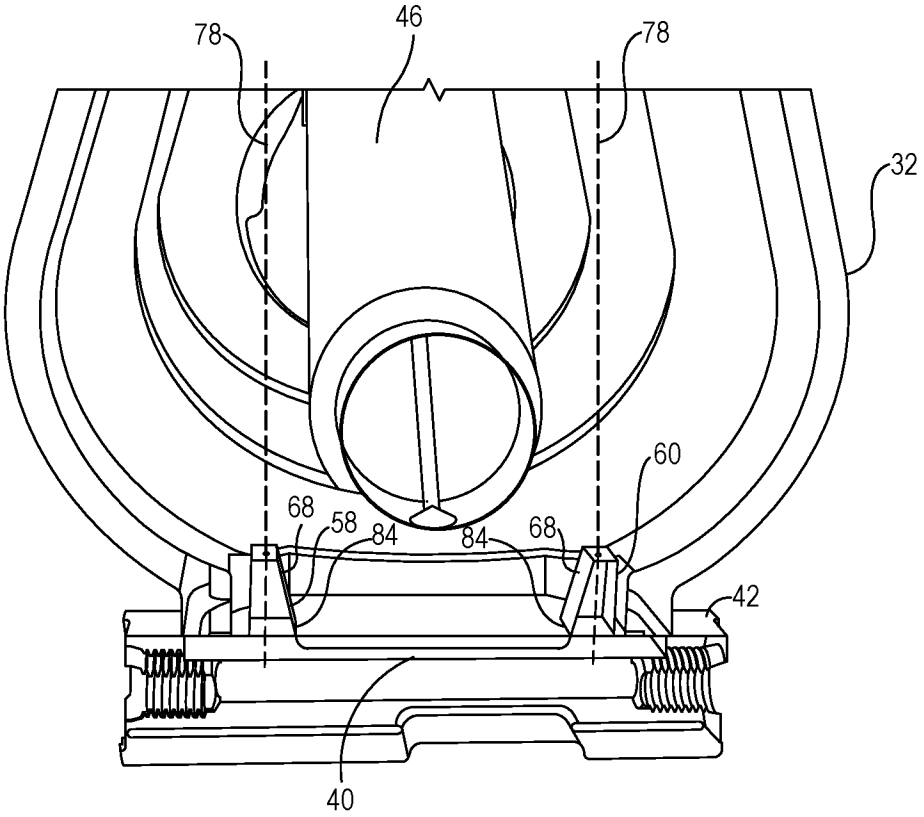
FIG. 9 is a side cross-sectional view illustrating a flow of the coolant from one of the cooling blocks into the crankcase, constructed in accordance with the present disclosure.

In addition, a channel 72 may extend through each of the raised portions 68 and provide fluid communication between the internal conduit 66 and the orifices 62 and 64 (see FIG. 9). As such, the coolant may flow into the channels 72 from the internal conduit 66, and may exit the nozzles 58 and 60 through the respective orifices 62 and 64. In one arrangement, the orifices 62 and 64 (and the channels 72) may each have a diameter of about 0.8 millimeters. However, the diameters of the orifices 62 and 64 (and the channels 72) may deviate from this in alternative designs.

The cooling block 42 may have a rectangular shape with its length (l) being greater than its width (w). In one arrangement, the length (l) of the cooling block 42 may be about 103 millimeters, and the width (w) of the cooling block 42 may be about 54 millimeters. However, the dimensions and the shape of the cooling block 42 may vary depending on the design of the air compressor 38 or other considerations. The cooling block 42 may further include one or more bolt holes 74 for bolting the cooling block 42 onto the bottom of the air compressor 38 (see FIG. 10 and further details below). In alternative arrangements, the cooling block 42 may have additional or alternative features to facilitate its connection to the air compressor 38.

Figure 7:
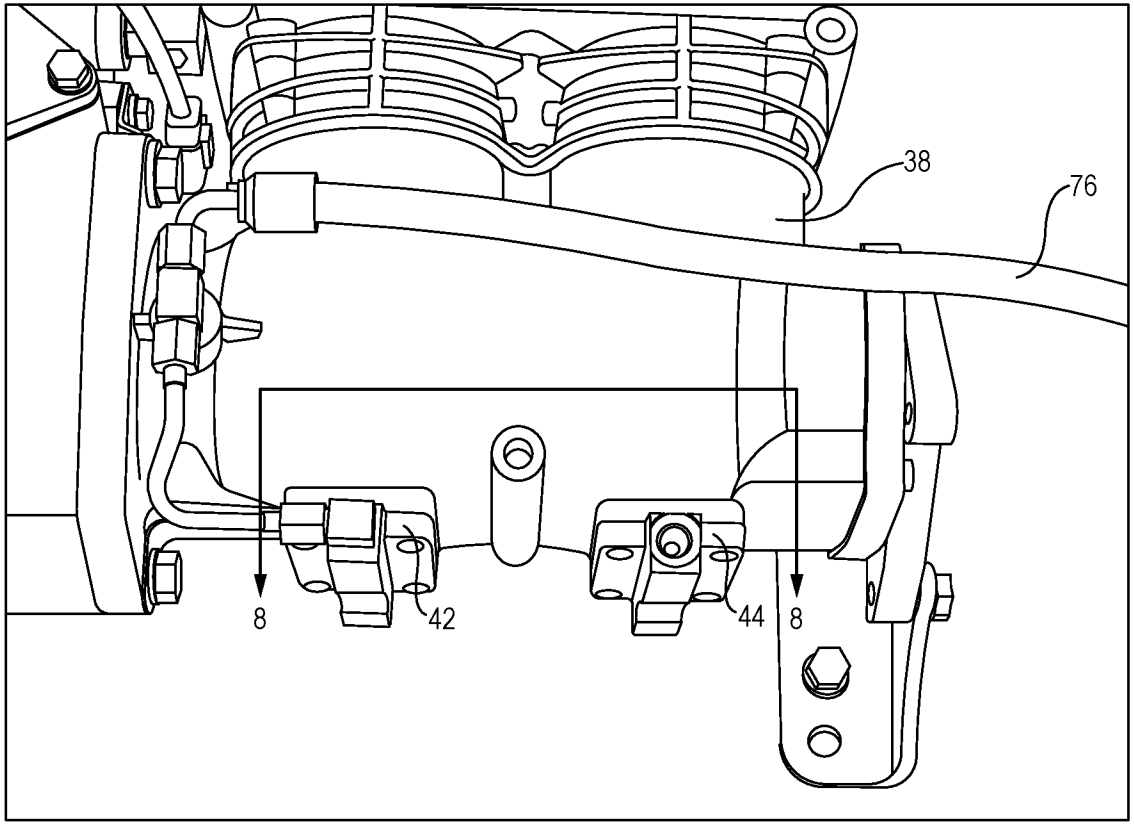
FIG. 7 is a perspective view of the cooling blocks assembled with the dual cylinder air compressor, constructed in accordance with the present disclosure.

Referring to FIG. 7, the coolant may be supplied to the cooling block 42 through one or more coolant supply lines 76 running from the engine 12. Although not shown in FIG. 7 for clarity purposes, the second cooling block 44 may receive the coolant from the supply line 76 or a different supply line in a similar manner.

Figure 8:
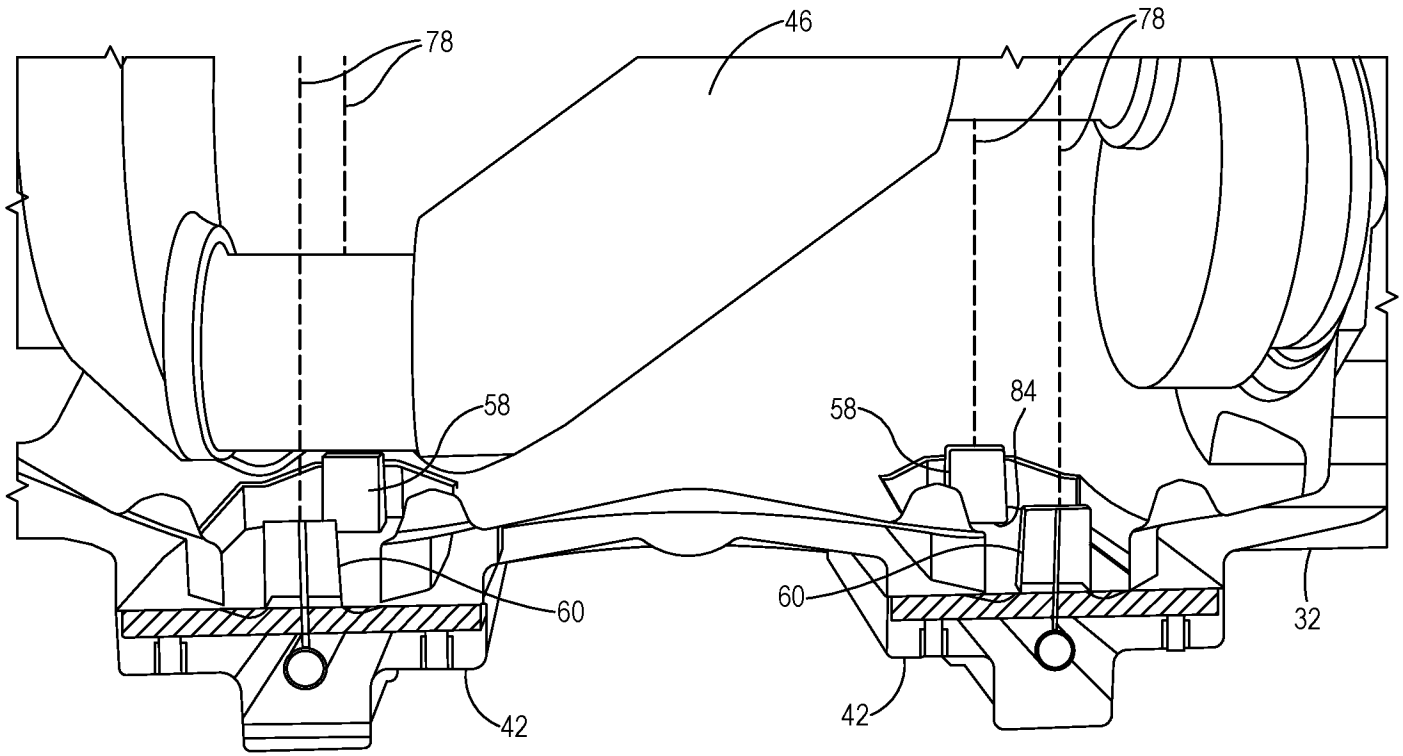
FIG. 8 is a cross-sectional view through the section 8-8 of FIG. 7, illustrating a flow of coolant from the cooling blocks into the crankcase of the dual cylinder air compressor, constructed in accordance with the present disclosure.

The flow of the coolant 78 through the orifices 62 and 64 and into the crankcase 32 is shown in FIGS. 8-9. The first cooling block 42 may supply the coolant 78 to one of the pistons 36 of one of the two cylinders 34, and the second cooling block 44 may supply the coolant 78 to the other piston 36 of the other of the two cylinders 34 (see FIG. 8). The first and second orifices 62 and 64 of each of the cooling blocks 42 and 44 may be spaced such that the coolant 78 is able to flow past the crankshaft 46 with both coolant flows impinging on the piston 36 at some rotation angles of the crankshaft 46 (see FIGS. 8-9). At some rotation angles of the crankshaft 46, one of the coolant flows from one of the orifices 62 and 64 may be at least partially blocked by the crankshaft 46. However, the cooling blocks 42 and 44 may deliver sufficient coolant to the pistons 36 such that the pistons are 100% covered by coolant regardless of the rotation angle of the crankshaft 46. At a coolant pressure of about 40 psi, the cooling blocks 42 and 44 may spray the coolant 78 into the crankcase 32 at a flow rate of about 27 milliliters (mL) per second. However, this flow rate may deviate depending on the pressure of the coolant, the design of the cooling blocks 42 and 44, and other factors. In addition, as noted above, the raised portions 68 of the first and second cooling nozzles 58 and 60 may allow the coolant sprays to clear any oil that may collect at the bottom 40 of the crankcase 32 (see FIG. 9).

Figure 10:
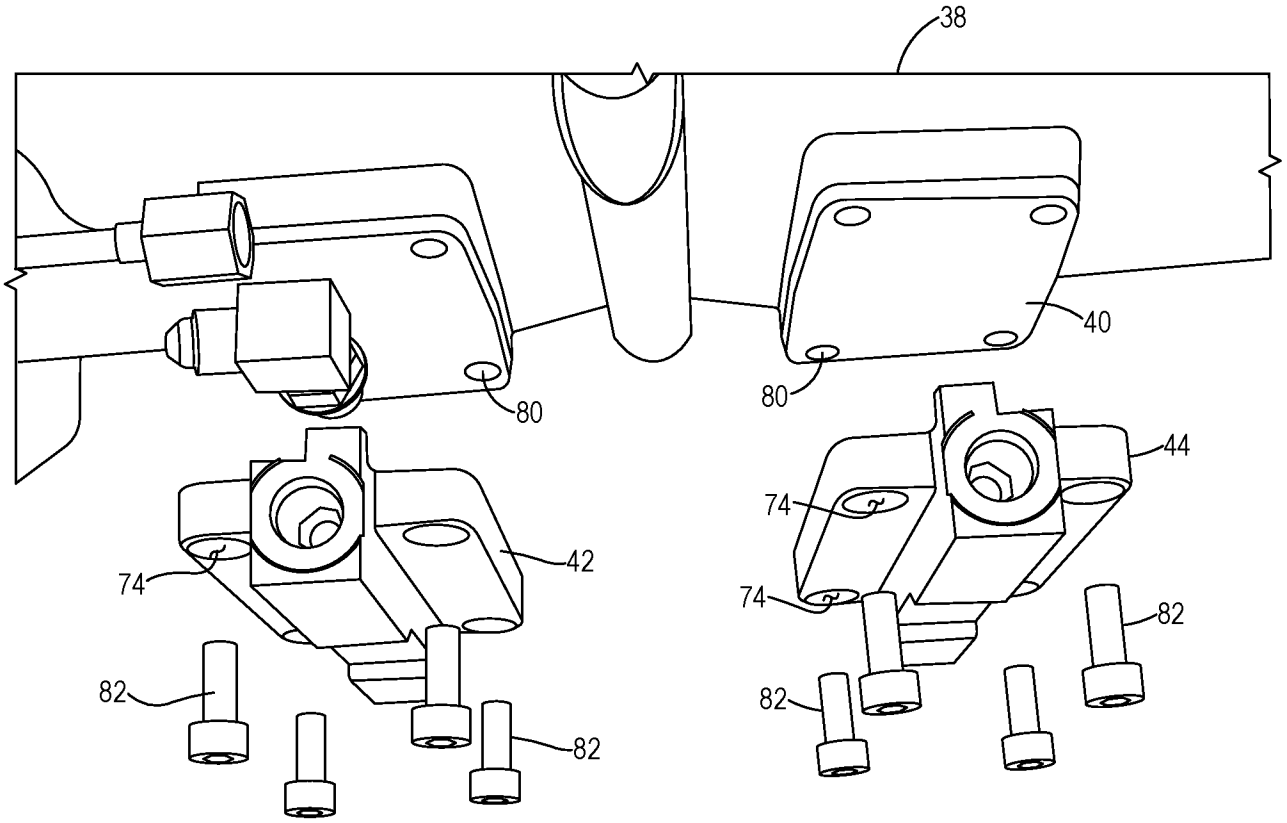
FIG. 10 is an exploded view of the assembly of the dual cylinder air compressor and the cooling blocks, constructed in accordance with the present disclosure.

The assembly of the first and second cooling blocks 42 and 44 with the dual cylinder air compressor 38 is shown in FIG. 10. Covers (not shown) that are on the bottom 40 of the crankcase 32 may be removed prior to the assembly of the air compressor 38 with the cooling blocks 42 and 44. The bottom 40 of the crankcase 32 may have receiving holes 80 that align with the bolt holes 74 of the cooling blocks 42 and 44 to receive bolts 82 that fasten the cooling blocks 42 and 44 to the dual cylinder air compressor 38. Other means for fastening the cooling blocks 42 and 44 to the air compressor38 may be used in alternative arrangements. The bottom 40 of the air compressor 38 may have apertures 84 that receive the first and second cooling nozzles 58 and 60 to allow the first and second cooling nozzles 58 and 60 to insert inside of the crankcase 32 (see FIGS. 8-9).

Although shown and described for use on an armored hull vehicle, the cooling blocks disclosed herein may be used to supply coolant to pistons of multi-cylinder air compressors used in various other applications having high compressed air demands such as, but not limited to, utility vehicles, or rail vehicles.

INDUSTRIAL APPLICABILITY

In general, the teachings of the present disclosure may find applicability in many industries including, but not limited to, combat vehicle industries. More specifically, the teachings of the present disclosure may find applicability in any industry using multi-cylinder air compressors for meeting high compressed air demands.

Figure 11:
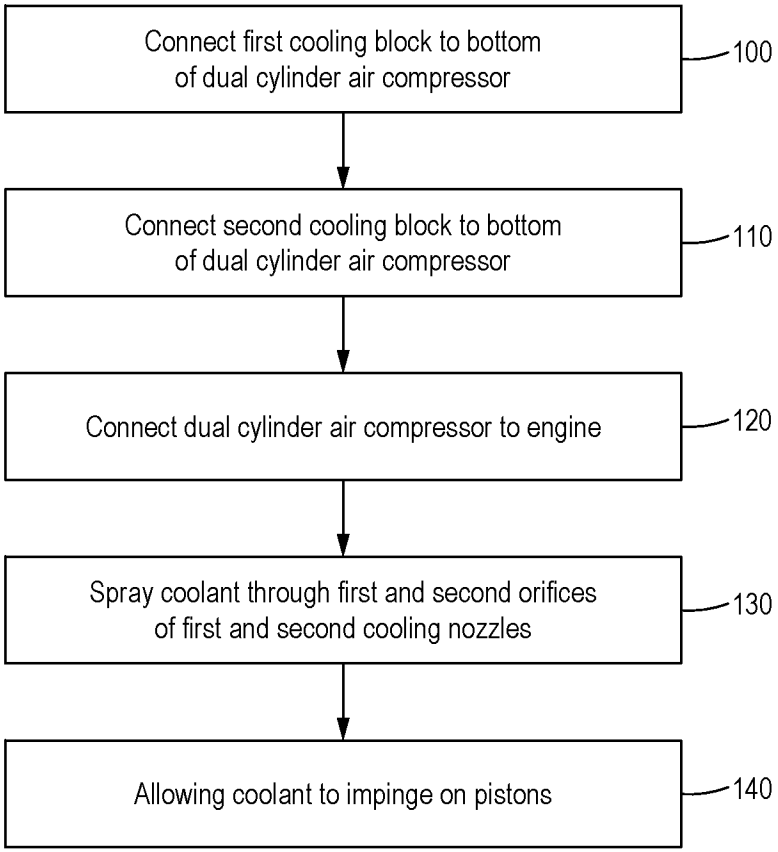
FIG. 11 is a flow chart of a series of steps that may be involved in assembling the cooling blocks with the dual cylinder air compressor and in using the cooling blocks to cool the pistons of the air compressor, in accordance with a method of the present disclosure.

FIG. 11 shows a series of steps that may be involved in assembling the cooling blocks 42 and 44 with the dual cylinder air compressor 38, and in using the cooling blocks 42 and 44 to cool the pistons 36 of the air compressor 38. After the bottom covers of the dual cylinder air compressor 38 are removed from the crankcase 32, the first and second cooling blocks 42 and 44 may be connected to the bottom 40 of the crankcase 32, such as by bolting the cooling blocks 42 and 44 to the crankcase 32 (blocks 100 and 110; see FIG. 10). According to a block 120, the engine and air compressor system 30 may be assembled by mounting the dual cylinder air compressor 38 to the engine 12 and connecting the cooling blocks 42 and 44 to the coolant supply line(s) 76. If not already mounted to the vehicle 10, the engine and air compressor system 30 thus assembled may be mounted to the vehicle 10. The blocks 100, 110, and 120 may be carried out in various orders.

During operation of the vehicle 10, the coolant 78 supplied by the engine 12 may be sprayed through the first and second orifices 62 and 64 of each of the first and second cooling nozzles 58 and 60 (block 130; see FIGS. 8-9). The coolant 78 may then impinge on the pistons 36 (block 140), with each of the cooling blocks 42 and 44 providing coolant to one of the pistons 36. The coolant 78 may be sprayed past the crankshaft 46 and cover 100% of the pistons 36 regardless of the rotation angle of the crankshaft 46. The method of FIG. 11 may be adapted accordingly for multi-cylinder air compressors having more than two cylinders.

The cooling blocks disclosed herein are designed for cooling the pistons of multi-cylinder air compressors. Each cooling block includes at least two cooling nozzles configured to spray coolant to one of the cylinders of the multi-cylinder air compressor. The cooling nozzles are spaced apart such that coolant is able to flow past the crankshaft of the air compressor at all rotation angles of the crankshaft. At certain rotation angles of the crankshaft, the coolant from both of the cooling nozzles is able to flow past the crankshaft and impinge on the piston. At other rotation angles of the crankshaft, the coolant from one of the cooling nozzles is able to flow past the crankshaft and impinge on the piston, and the coolant flow from the other cooling nozzle may be blocked or at least partially blocked. However, the pistons of each cylinder are completely covered with coolant at all times regardless of the rotation angle of the crankshaft. The cooling blocks disclosed herein increases the duty cycle of the pistons, allowing the pistons to run continuously and better meet the demands on the air compressor.

What is claimed is:

1. A dual cylinder air compressor for a vehicle, comprising:

a crankcase;

a crankshaft rotatably mounted in the crankcase;

two connecting rods mounted on the crankshaft;

two cylinders mounted in the crankcase;

two pistons each being arranged in a respective one of the two cylinders at an end of a respective one of the two connecting rods;

a first cooling block connected to a bottom of the crankcase and configured to spray coolant to one of the two pistons; and a second cooling block connected to the bottom of the crankcase and configured to spray coolant to the other of the two pistons, the first and second cooling blocks each including:

a coolant inlet;

a first cooling nozzle having a first orifice through which a coolant is sprayed into a crankcase of the dual cylinder air compressor;

a second cooling nozzle having a second orifice through which the coolant is sprayed into the crankcase.

2. The dual cylinder air compressor of claim 1, wherein the dual cylinder air compressor is configured to supply compressed air to a central tire air inflation system of the vehicle.

3. A system, comprising:

a multi-cylinder air compressor; and a cooling block for cooling a piston of the multi-cylinder air compressor, the cooling block comprising:

a coolant inlet;

a first cooling nozzle having a first orifice through which a coolant is sprayed into a crankcase of the multi-cylinder air compressor;

a second cooling nozzle having a second orifice through which the coolant is sprayed into the crankcase.

4. The system of claim 3, wherein the second cooling nozzle is spaced apart from the first cooling nozzle so as to define a horizontal direction, and wherein each of the first and second cooling nozzles includes:

a raised portion that protrudes away from a body of the cooling block along a vertical direction, the first and second orifices being at a top portion of the respective raised portion in the vertical direction; and a channel extending through the raised portion and providing fluid communication between an internal conduit within the cooling block and the respective first or second orifice.

5. The system of claim 4, wherein the raised portions have a height of about 7 millimeters.

6. The system of claim 3, wherein the first and second orifices are spaced apart by about 56 millimeters.

7. The system of claim 3, wherein each of the first and second orifices has a diameter of about 0.8 millimeters.

8. The system of claim 3, wherein the cooling block is connected to a bottom of the crankcase.

9. The system of claim 8, wherein the cooling block includes bolt holes for bolting the cooling block to the bottom of the crankcase.

10. The system of claim 3, wherein each of the first and second cooling nozzles is configured to spray the coolant past a crankshaft into one of the cylinders of the multi-cylinder air compressor when the cooling block is connected to the multi-cylinder air compressor.

11. The system of claim 3, further comprising:

a body including a first end and a second end, the first and second ends being on opposing sides of the body;

the first cooling nozzle being closer to the first end than the second end;

the second cooling nozzle being closer to the second end than the first end; and an internal conduit extending through the body and configured to carry the coolant from the coolant inlet to each of the first and second cooling nozzles.

12. The system of claim 3, wherein the multi-cylinder air compressor is a liquid cooled multi-cylinder air compressor.

13. An engine and air compressor system for a vehicle, comprising:

an engine;

a dual cylinder air compressor connected to and driven by the engine and configured to supply compressed air, the dual cylinder air compressor including a crankcase having a bottom, a crankshaft rotatably mounted in the crankcase, two connecting rods mounted on the crankshaft, two cylinders mounted in the crankcase, and two pistons each being arranged within a respective one of the two cylinders at an end of a respective one of the two connecting rods; and first and second cooling blocks each connected to the bottom of the crankcase and configured to spray coolant into the crankcase for cooling the pistons, each of the first and second cooling blocks including:

a coolant inlet, a first cooling nozzle having a first orifice through which the coolant is sprayed into the crankcase, a second cooling nozzle having a second orifice through which the coolant is sprayed into the crankcase, the second cooling nozzle being spaced apart from the first cooling nozzle so as to define a horizontal direction, each of the first and second cooling nozzles including a raised portion that protrudes away from a body of the cooling block along a vertical direction, the first and second orifices being at a top portion of the respective raised portion in the vertical direction, and a channel extending through the raised portion and providing fluid communication between an internal conduit within the cooling block and the respective first or second orifice.

14. The engine and air compressor system of claim 13, wherein the first and second cooling blocks allow the pistons to run continuously.

15. The engine and air compressor system of claim 13, wherein each of the first and second cooling blocks is configured to spray the coolant past the crankshaft to a respective one of the pistons.

16. The engine and air compressor system of claim 13, wherein the first and second cooling blocks are configured to spray the coolant into the crankcase at a flow rate of about 27 milliliters per second.

17. The engine and air compressor system of claim 13, wherein:

the body of each of the first cooling block and the second cooling block has a first end and a second end on opposing sides of the cooling block;

the first cooling nozzle of each cooling block is positioned closer to the first end than the second end; and the second cooling nozzle of each cooling block is positioned closer to the second end than the second end.

18. The engine and air compressor system of claim 13, wherein each internal conduit is configured to carry the coolant from the coolant inlet to each of the first and second cooling nozzles.

19. The engine and air compressor system of claim 8, wherein the raised portions elevate the first and second orifices above a pool of oil collected at the bottom of the crankcase.

20. The engine and air compressor system of claim 8, wherein the raised portions of each of the first and second cooling nozzles has a height of about 7 millimeters.

* * * * *